US010035676B2

(12) United States Patent
Shirasaki

(10) Patent No.: US 10,035,676 B2
(45) Date of Patent: Jul. 31, 2018

(54) SHEET CONVEYING DEVICE AND IMAGE FORMING APPARATUS THEREWITH

(71) Applicant: KYOCERA Document Solutions Inc., Osaka (JP)

(72) Inventor: Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 65 days.

(21) Appl. No.: 15/393,638

(22) Filed: Dec. 29, 2016

(65) Prior Publication Data

US 2017/0240376 A1 Aug. 24, 2017

(30) Foreign Application Priority Data

Feb. 18, 2016 (JP) ..... 2016-029138

(51) Int. Cl.

| | |
|---|---|
| ***B65H 31/22*** | (2006.01) |
| ***B65H 37/04*** | (2006.01) |
| ***B65H 29/12*** | (2006.01) |
| ***B65H 35/00*** | (2006.01) |
| ***B65H 31/02*** | (2006.01) |

(52) U.S. Cl.

CPC ..... *B65H 37/04* (2013.01); *B65H 29/125* (2013.01); *B65H 31/02* (2013.01); *B65H 31/22* (2013.01); *B65H 35/0086* (2013.01); *B65H 2301/4212* (2013.01); *B65H 2301/4213* (2013.01); *B65H 2402/10* (2013.01); *B65H 2402/32* (2013.01); *B65H 2402/62* (2013.01); *B65H 2601/321* (2013.01); *B65H 2801/27* (2013.01)

(58) Field of Classification Search

CPC ..... B65H 2402/62; B65H 31/22; B65H 2601/321; B65H 2402/10; B65H 2402/32; G03G 2221/1696

See application file for complete search history.

(56) References Cited

U.S. PATENT DOCUMENTS

| | | | | |
|---|---|---|---|---|
| 5,203,552 A * | 4/1993 | Hoshi | B65H 3/44 271/164 |
| 9,056,743 B2 * | 6/2015 | Sato | B65H 29/125 |
| 2006/0210337 A1 | 9/2006 | Nagata et al. | 399/407 |

(Continued)

FOREIGN PATENT DOCUMENTS

| | | |
|---|---|---|
| JP | 2006-240759 A | 9/2006 |
| JP | 2008007305 A * | 1/2008 |
| JP | 2012-230280 A | 11/2012 |

*Primary Examiner* — Jennifer Simmons

(74) *Attorney, Agent, or Firm* — Stein IP, LLC

(57) ABSTRACT

A sheet conveying device has a body and a frame supporting it, and is insertable or extractable along a sheet stacking face formed in an in-body discharge space in an image forming apparatus and having an inclined face with an upward gradient toward the downstream side in the sheet discharge direction. On the face of the frame opposite the sheet stacking face, a plurality of first and second wheels rotatable in the insertion or extraction direction are provided downward of the center of the opposite face in the insertion direction. The first wheels are arranged downstream of the second wheels in the insertion direction, and protrude from the opposite face farther than the second wheels. The first wheels fit into a concave portion formed in the sheet stacking face by the inclined face and thereby enable the second wheels to make contact with the sheet stacking face.

8 Claims, 6 Drawing Sheets

(56) References Cited

U.S. PATENT DOCUMENTS

| | | | | |
|---|---|---|---|---|
| 2012/0134728 | A1* | 5/2012 | Kotera | G03G 15/5004 399/407 |
| 2012/0275820 | A1 | 11/2012 | Eto | 399/110 |
| 2016/0159589 | A1* | 6/2016 | Kuwata | B65H 1/04 271/9.11 |

* cited by examiner

SHEET CONVEYING DEVICE AND IMAGE FORMING APPARATUS THEREWITH

INCORPORATION BY REFERENCE

This application is based upon and claims the benefit of priority from the corresponding Japanese Patent Application No. 2016-29138 filed on Feb. 18, 2016, the entire contents of which are incorporated herein by reference.

BACKGROUND

The present disclosure relates to a sheet conveying device that is inserted in an in-body discharge space in an image forming apparatus, and to an image forming apparatus provided with such a sheet conveying device.

Conventionally, sheet post-processing devices are used that stack a plurality of sheets having images formed on them by an image forming apparatus such as a copier or printer and that can then perform processes such as a binding process, whereby the bunch of stacked sheets are stapled together, and a punch hole forming process, whereby punch holes (perforations) are formed using a punch hole forming device.

When such a sheet post-processing device is attached to a side face of an image forming apparatus, inconveniently, the image forming apparatus occupies an extra installation space as large as the attached sheet post-processing device. As a solution, an image forming apparatus is known in which a sheet post-processing device is slidably arranged in a space (in-body discharge space), inside its body, that is formed by a document reading section, a printing section, and a sheet feeding section.

A construction is also known in which an image forming unit is slidably supported on the main body of an image forming apparatus by a pair of slide rails and a support portion formed substantially parallel to the slide rails so that, when the image forming unit is inserted into the image forming apparatus, second wheels run out of grooves in the slide rails to permit the image forming unit to be arranged at a predetermined position.

SUMMARY

According to one aspect of the present disclosure, a sheet conveying device includes a body and a frame. The body includes a sheet conveying mechanism. The frame supports the body. The sheet conveying device is attached so as to be insertable and extractable along a sheet stacking face formed in an in-body discharge space of an image forming apparatus, the sheet stacking face having an inclined face with an upward gradient toward the downstream side in the sheet discharge direction. On the opposite face of the frame located opposite the sheet stacking face, a plurality of first wheels and second wheels are provided. The first and second wheels are arranged to the downstream side from the center of the opposite face in the insertion direction, and are rotatable in the insertion or extraction direction. The first wheels are arranged on the downstream side of the second wheels in the insertion direction, and protrude from the opposite face by a larger amount than the second wheels. The first wheels fit into a concave portion formed in the sheet stacking face by the inclined face to enable the second wheels to make contact with the sheet stacking face.

Further features and advantages of the present disclosure will become apparent from the description of embodiments given below.

DETAILED DESCRIPTION

Figure 1:
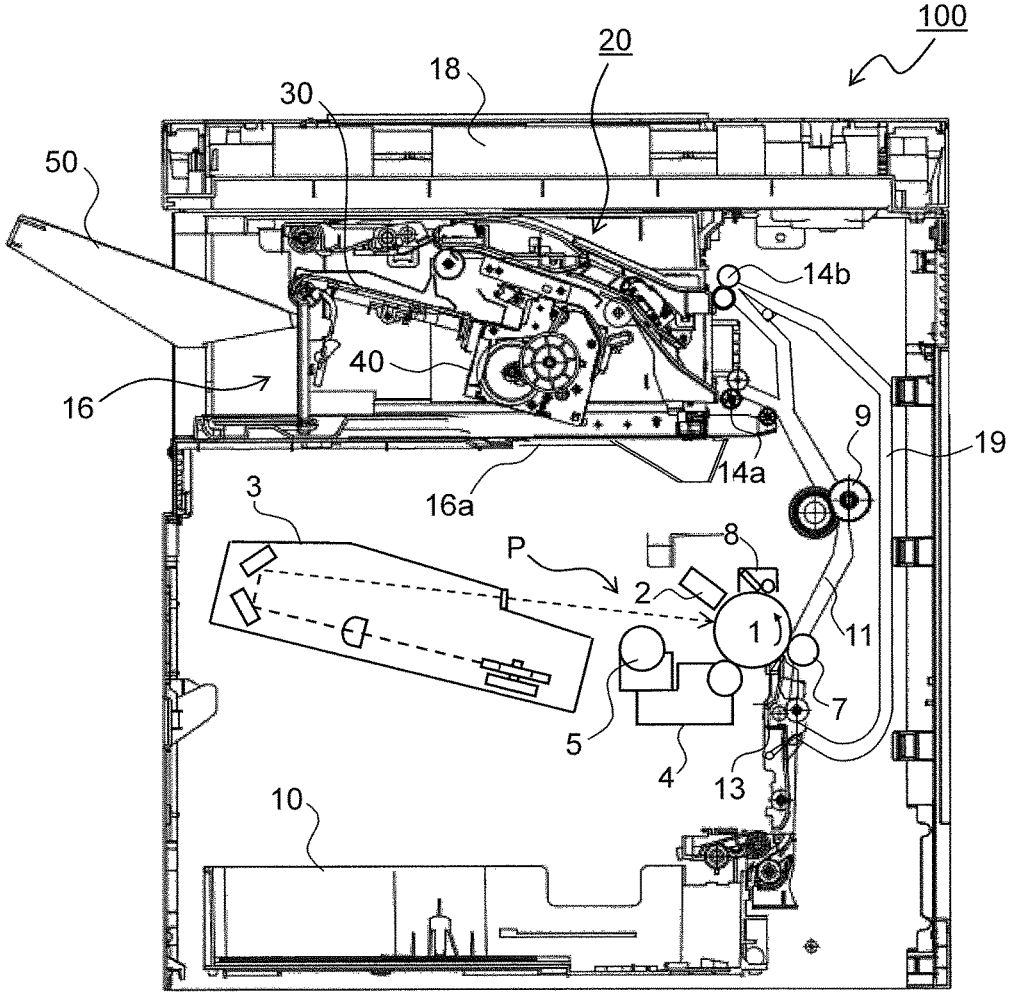
FIG. 1 is a schematic diagram showing an internal construction of an image forming apparatus having a sheet post-processing device attached to it according to the present disclosure.

An embodiment of the present disclosure will be described below with reference to the accompanying drawings. FIG. 1 is a schematic diagram showing an internal construction of an image forming apparatus 100 and a sheet post-processing device 20 according to the present disclosure. Although, in this embodiment, a digital multifunction peripheral is taken as an example of the image forming apparatus 100, the sheet post-processing device 20 according to the present disclosure can be similarly coupled to any apparatus other than a digital multifunction peripheral, for example to a laser printer, inkjet printer, facsimile machine, or the like.

As shown in FIG. 1, inside a main body of the image forming apparatus (for example, a monochrome multifunction peripheral) 100, an image forming section P which forms a monochrome image through the processes of electrostatic charging, exposure to light, image development, and image transfer is arranged.

In the image forming section P, a charging section 2, an exposure unit 3, a developing device 4, a transfer roller 7, a cleaning device 8, and a destaticizing device (not shown) are arranged along the rotation direction of a photosensitive drum 1 (counter-clockwise direction in FIG. 1).

The photosensitive drum 1 has, for example, a photosensitive layer laid on an aluminum drum, and the photosensitive layer on its surface is electrostatically charged uniformly by the charging section 2. On the surface irradiated with a laser beam from the exposure unit 3, which will be described later, an electrostatic latent image is formed through attenuation of electric charge.

The charging section 2 electrostatically charges the surface of the photosensitive drum 1 uniformly. As charging section 2, for example, a corona discharge device which discharges electric charge by applying a high voltage to thin wire or the like as an electrode is used. The exposure unit 3 irradiates the photosensitive drum 1 with a light beam (for example, laser beam) based on document image data read by an image reading section 18, and forms an electrostatic latent image on the surface of the photosensitive drum 1.

The developing device 4 attaches toner to the electrostatic latent image on the photosensitive drum 1 to form a toner image. The toner is supplied to the developing device 4 by a toner container 5.

The transfer roller 7 transfers, without disturbing, the toner image formed on the surface of the photosensitive drum 1 to a sheet conveyed along a sheet conveyance passage 11. The cleaning device 8 is provided with a cleaning roller, cleaning blade, or the like that makes line contact in the longitudinal direction of the photosensitive drum 1, and removes remaining toner that remains on the surface of the photosensitive drum 1 after the transfer of the toner image to the sheet.

The image reading section 18 is composed of a scanning optical system incorporating a scanner lamp which illuminates a document during copying and a mirror which changes the optical path of the reflected light from the document, a converging lens which converges and images the reflected light from the document, a CCD sensor which converts the imaged image light into an electrical signal (none is illustrated) and reads the document image and converts it into image data, and the like.

When a copying operation is performed, the image data of the document is read and is converted into an image signal in the image reading section 18. On the other hand, in the image forming section P, the photosensitive drum 1, which rotates in the counter-clockwise direction in the figure, is electrostatically charged uniformly by the charging section 2. Subsequently, the exposure unit 3 irradiates the photosensitive drum 1 with a laser beam (a ray of light) based on the document image data read in the image reading section 18, and thereby forms an electrostatic latent image based on the image data on the surface of the photosensitive drum 1. Thereafter, the developing device 4 attaches toner to the electrostatic latent image to form a toner image.

Toward the image forming section P in which the toner image has been formed as described above, a sheet is conveyed with predetermined timing from a sheet storage section 10 through the sheet conveyance passage 11 via a pair of registration rollers 13, and in the image forming section P, the toner image on the surface of the photosensitive drum 1 is transferred to the sheet by the transfer roller 7. Then the sheet having the toner image transferred to it is separated from the photosensitive drum 1, is conveyed to a fixing section 9, and is exposed to heat and pressure so that the toner image is fixed to the sheet.

The sheet having passed through the fixing section 9 passes through the sheet conveyance passage 11 and is conveyed to a pair of discharge rollers 14*a* or 14*b*. In a case where an image is formed only on one side of the sheet, the sheet is conveyed into the sheet post-processing device 20, which is attached in an in-body discharge space 16, by the pair of discharge rollers 14*a*.

On the other hand, in a case where images are formed on both sides of the sheet, the sheet is distributed into a reverse conveyance passage 19 by rotating the pair of discharge rollers 14*b* in a reverse direction, so that the sheet is conveyed, with the image side reversed, once again to the pair of registration rollers 13. Then the next image formed on the photosensitive drum 1 is transferred by the transfer roller 7 to the side of the sheet on which no image has been formed yet, the sheet is conveyed to the fixing section 9 so that the toner image is fixed, and the sheet is conveyed into the sheet post-processing device 20 by the pair of discharge rollers 14*a*.

The sheet post-processing device 20 is removably attached to the bottom face 16*a* of the in-body discharge space 16. With the sheet post-processing device 20 detached from the in-body discharge space 16, the bottom face 16*a* is used as a sheet discharge tray. The bottom face 16*a* has an inclined face, which inclines upward along the discharge direction, to align the tail ends of sheets discharged by the pair of discharge rollers 14*a* or 14*b*. In a substantially central part of the bottom face 16*a*, a convex portion 70 (see FIG. 6) which allows easy removal of the sheets discharged on the bottom face 16*a* is formed.

Figure 2:
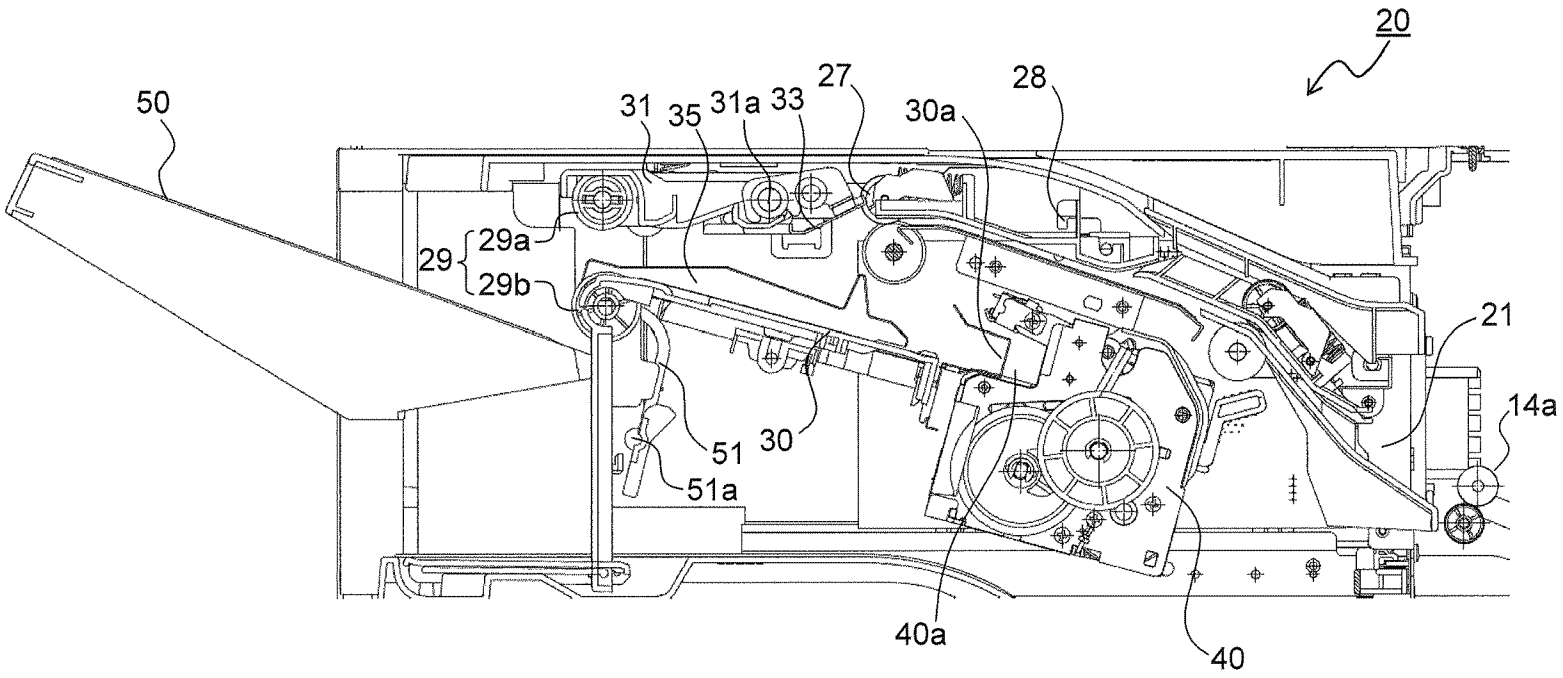
FIG. 2 is an enlarged view of part of the sheet post-processing device in FIG. 1.

FIG. 2 is a side sectional view of the sheet post-processing device 20. The sheet post-processing device 20 is provided with, inside it, a punch hole forming device (not shown) which forms punch holes in sheets brought in, a processing tray 30 on which a plurality of sheets brought in are stacked, and a stapler 40 which binds a bundle of sheets stacked on the processing tray 30 with staples. On a side face of the sheet post-processing device 20, a discharge tray 50 that can be moved up and down to a position suitable for discharge of sheets is provided.

At a position on the sheet post-processing device 20 opposite the pair of discharge rollers 14*a*, a sheet entry port 21 is provided. In a substantially central part of the sheet entry port 21 in the direction (direction perpendicular to the plane of FIG. 2) perpendicular to the sheet conveyance direction, an entry detection sensor (not shown) which detects the head end of a sheet brought into the sheet post-processing device 20 by the pair of discharge rollers 14*a* is arranged.

On the downstream side of the sheet entry port 21 in the sheet conveyance direction, the punch hole forming device is arranged, and on the downstream side of the punch hole forming device, an actuator-type sheet detection sensor 28 which detects passage of a sheet is arranged. On the downstream side of the sheet detection sensor 28, a pair of first discharge rollers 27 is arranged. Furthermore, under the pair of first discharge rollers 27, the processing tray 30 on which a plurality of sheets conveyed by the pair of first discharge rollers 27 are stacked in an aligned state and the stapler 40 which performs a binding process on the bundle of sheets (sheet bundle) stacked on the processing tray 30 are provided.

On the downstream side of the processing tray 30 in the sheet conveyance direction, a pair of second discharge rollers 29 which discharges a sheet bundle from the processing tray 30 to the discharge tray 50 is arranged. The pair of second discharge rollers 29 is composed of a discharge roller 29*a* made of rubber and rotatable in forward and reverse directions by a drive motor (not shown) and discharge wheels 29*b* made of resin and rotatable by following the discharge roller 29*a*. The discharge roller 29*a* is supported by a roller holder 31 which is swingable up and down about a rotation shaft 31*a*.

Over the processing tray 30, on the downstream side (left side in FIG. 2) of the pair of first discharge rollers 27, a beating member 33 which beats sheets brought in by the pair of first discharge rollers 27 in the direction of the processing tray 30 to lay the sheets along the tray surface. The processing tray 30 is arranged so as to incline downward toward the tail ends of the sheets stacked (rightward in FIG. 2), and as the pair of second discharge rollers 29 rotates in the reverse direction, sheets are, from the tail end side, drawn onto the processing tray 30 and the tail ends of the sheets rest on a dead end 30*a*. Thus the sheets are stacked, with their tail ends aligned, on the processing tray 30. Moreover, on the processing tray 30, a pair of side end aligning cursors 35 which aligns the bundle of sheets stacked on the processing tray 30 in the width direction (direction perpendicular to the plane of FIG. 2) is provided.

The stapler 40 is movable in the sheet width direction perpendicular to the conveyance direction by a moving mechanism (not shown), and moves to a predetermined position along the dead end 30*a* of the processing tray 30 according to the content of a binding process.

Next, the operation of the sheet post-processing device 20 will be described. When sheets having undergone an image forming process in the image forming apparatus 100 are brought in, if punch hole formation is specified, punch holes are formed, by the punch hole forming device (not shown), at predetermined positions (for example, at two places along the side edge on the front side of the apparatus) in the sheets conveyed, and if punch hole formation is not specified, the sheets simply pass through the punch hole forming device.

Then the sheets brought into the sheet post-processing device 20 are conveyed farther to the downstream side by the pair of first discharge rollers 27. At this time, as shown in FIG. 2, the roller holder 31 is swung up, and the discharge roller 29*a* is arranged at a position (displaced position) away from the discharge wheels 29*b*. Accordingly, the sheets conveyed by the pair of first discharge rollers 27 pass between the discharge roller 29*a* and the discharge wheels 29*b* to protrude onto the discharge tray 50.

At the time that the tail end of the sheets has passed the pair of first discharge rollers 27, the roller holder 31 is swung down to arrange the discharge roller 29*a* at a position (contact position) in contact with the discharge wheels 29*b*. Subsequently, the beating member 33 is driven to lay the sheets along the processing tray 30. In this state, when the discharge roller 29*a* is rotated in the reverse direction (counter-clockwise direction in FIG. 2), the sheets are drawn in along the processing tray 30, and their tail ends are aligned by the dead end 30*a*. At this time, a middle part of the sheets is nipped between the pair of second discharge rollers 29, and the head end of the sheets protrude from the pair of second discharge rollers 29 onto the discharge tray 50. When the sheets are drawn in along the processing tray 30, to prevent the sheets from being drawn more than necessary, the sheets are nipped in a state where the discharge roller 29*a* is in pressed contact with the discharge wheels 29*b* only under the weight of the roller holder 31 itself.

On completion of accepting one bundle of sheets, the stapler 40 is moved to a notched position on the dead end 30*a*, the tail end of the sheet bundle is inserted in a stapling section 40*a*, and a binding process on the sheet bundle is performed in the stapling section 40*a*. After the binding process on the sheet bundle in the stapling section 40*a*, the sheet bundle is conveyed upward along the processing tray 30 by rotating the pair of second discharge rollers 29 in the forward direction (clockwise direction in FIG. 2) and is discharged onto the discharge tray 50. When the sheet bundle is discharged onto the discharge tray 50, the discharge roller 29*a* is brought into pressed contact with the discharge wheels 29*b*, not only under the weight of the roller holder 31 itself, but also with the roller holder 31 biased downward by a biasing member such as a spring. This permits the sheet bundle to be nipped with a stronger force than when drawn in, and thus allows reliable discharge of the sheet bundle onto the discharge tray 50.

In a case where shifted discharge is specified, when the pair of second discharge rollers 29 is driven to discharge the sheet bundle onto the discharge tray 50, first, the roller holder 31 is moved to the displaced position. Then the side end aligning cursors 35 are arranged at the position (reference position) at which sheets were accepted, or at a position (shifted position) shifted from the reference position by a predetermined amount in the direction (sheet width direction) perpendicular to the discharge direction. Then, the roller holder 31 is moved to the contact position, and the sheets are discharged. Thus, sheet bundles are discharged alternately to the reference discharge position on the discharge tray 50 and to the shifted discharge position which is shifted from the reference discharge position by the predetermined amount in the direction (sheet width direction) perpendicular to the discharge direction, and are thereby sorted by being stacked alternately in the sheet width direction on the discharge tray 50.

Under the pair of second discharge rollers 29, a sheet pressing member 51 is arranged. The sheet pressing member 51 is supported so as to be swingable about a pivot 51*a* and, as shown in FIG. 2, is arranged selectively either at a retracted position retracted from the discharge tray 50 (not overlapping the discharge tray 50) or at a sheet pressing position protruded to a position overlapping the discharge tray 50 to press the top face of the sheet discharged onto the discharge tray 50.

Figure 3:
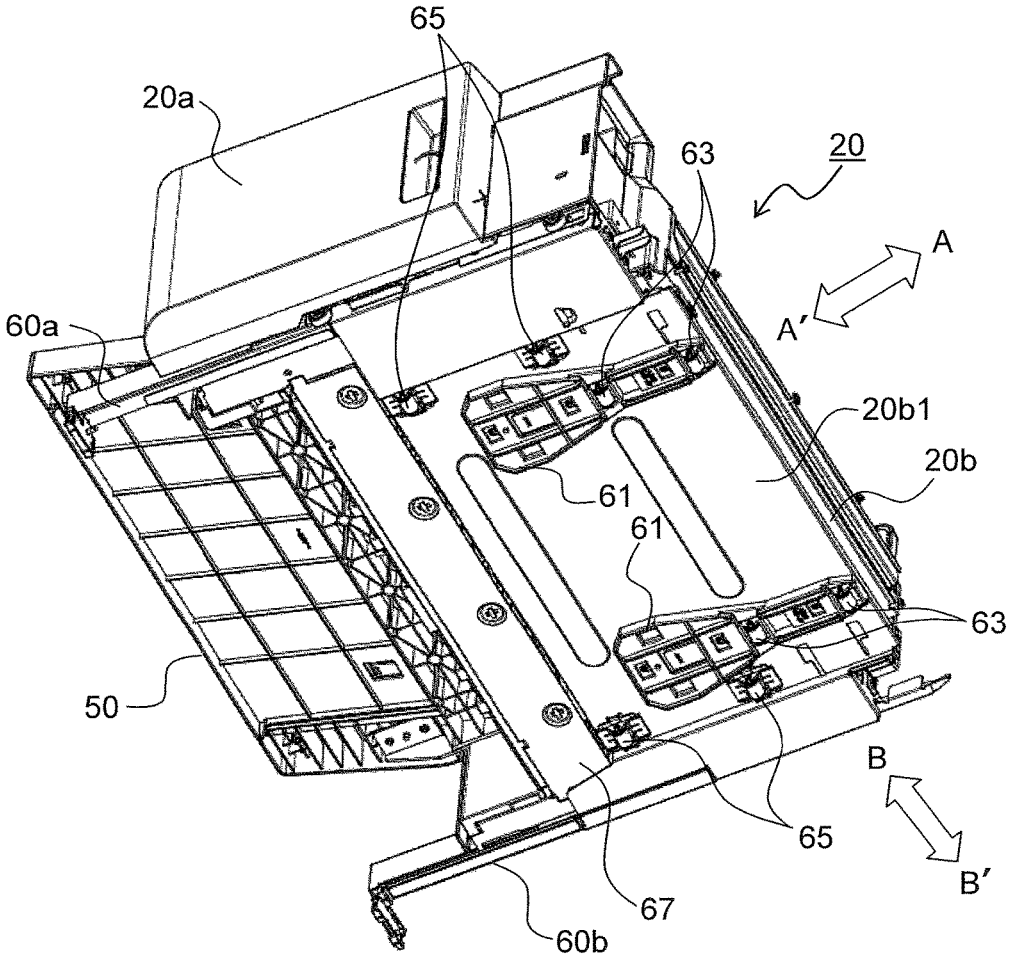
FIG. 3 is a perspective view of the sheet post-processing device as seen from below.
Figure 4:
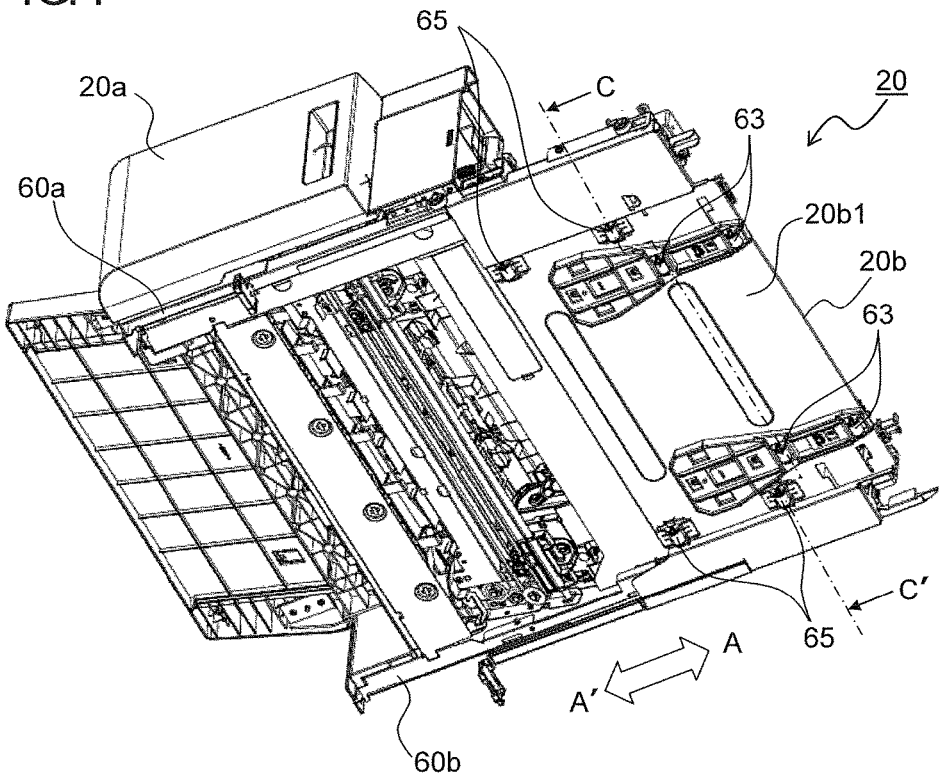
FIG. 4 is a perspective view of the sheet post-processing device, showing a state where, from the state in FIG. 3, a body has slid relative to a frame.

FIG. 3 is a perspective view of the sheet post-processing device 20 as seen from below, and FIG. 4 is a perspective view showing a state where, from the state in FIG. 3, a body 20*a* has been slid relative to a frame 20*b*. The sheet post-processing device 20 is composed of the body 20*a*, which houses the punch hole forming device, the processing tray 30, the stapler 40, and the like, and the frame 20*b*, which slidably supports the body 20*a*. The frame 20*b* constitutes the bottom face of the sheet post-processing device 20, and is located opposite the bottom face 16*a* (see FIG. 1) of the in-body discharge space 16.

At both end parts of the frame 20*b* in its width direction (direction indicated by arrows B-B' in FIG. 3) perpendicular to the insertion direction (direction indicated by arrow A in FIG. 3) of the sheet post-processing device 20, a pair of guide rails 60*a* and 60*b* are formed. As a result of slide wheels (not shown) on the body 20*a* moving along the guide rails 60*a* and 60*b*, the body 20*a* moves in the insertion direction relative to the frame 20*b*. When a sheet jam occurs in the in-body discharge space 16, the body 20*a* is slid in the extraction direction (direction indicated by arrow A') as shown in FIG. 4, and then the jam is dealt with.

To the opposite face 20*b*1 of the frame 20*b* located opposite the bottom face 16*a*, a pair of guide members 61 is fixed at a predetermined interval from each other in the width direction (direction indicated by arrows B-B'). On each guide member 61, a total of four first wheels 63, two at each side, are supported so as to be rotatable in the insertion direction (direction indicated by arrow A). The first rollers 63 are arranged to the downstream side from a central part of the frame 20*b* in the insertion direction of the sheet post-processing device 20.

Outward of the first wheels 63 in the width direction of the frame 20*b*, second wheels 65 are supported so as to be rotatable in the insertion direction (direction indicated by arrow A in FIG. 3). A total of four of the second wheels 65, two at each side, are arranged. The second wheels 65 are arranged on the upstream side of the first wheels 63, to the downstream side from the central part of the frame 20*b*, in the insertion direction of the sheet post-processing device 20.

Figure 5:
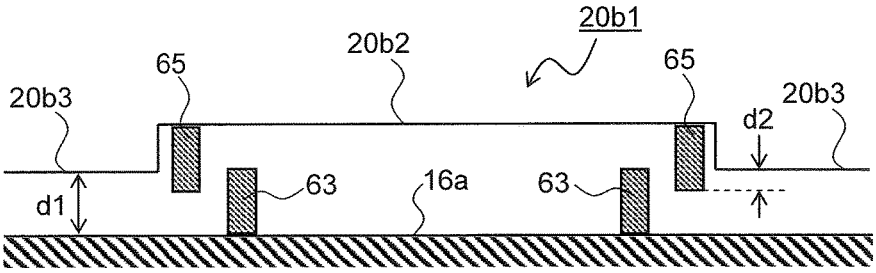
FIG. 5 is a sectional view of an opposite face of the frame, including first and second wheels.

FIG. 5 is a sectional view (sectional view along line C-C' as seen from the direction indicated by the arrows in FIG. 4) of the opposite face 20*b*1 of the frame 20*b* including the first and second wheels 63 and 65. As shown in FIG. 5, in a central part of the opposite face 20*b*1 in the width direction, a step portion 20*b*2 in a shape concave upward is formed, and on both sides of the step portion 20*b*2 in the width direction, a proximate portion 20*b*3 which is closest to the bottom face 16*a* of the in-body discharge space 16 is formed. The first and second wheels 63 and 65 are arranged in the step portion 20*b*2, at both end parts thereof in the width direction, that is, near both width-direction end parts of the frame 20*b*, where the guide rails 60*a* and 60*b* are formed. Relative to the opposite face 20*b*1 (proximate portion 20*b*3), the amount of protrusion d1 of the first wheels 63 is 3.5 mm, and the amount of protrusion d2 of the second wheels 65 is 0.5 to 1 mm, the second wheels 65 thus protruding by a smaller amount than the first wheels 63.

To the opposite face 20*b*1 of the frame 20*b*, along the upstream-side end edge in the insertion direction, an anti-slip plate 67 is fixed. The anti-slip plate 67 is formed of a material, such as rubber, that has a higher coefficient of friction to the bottom face 16*a* than the frame 20*b*.

Figure 6:
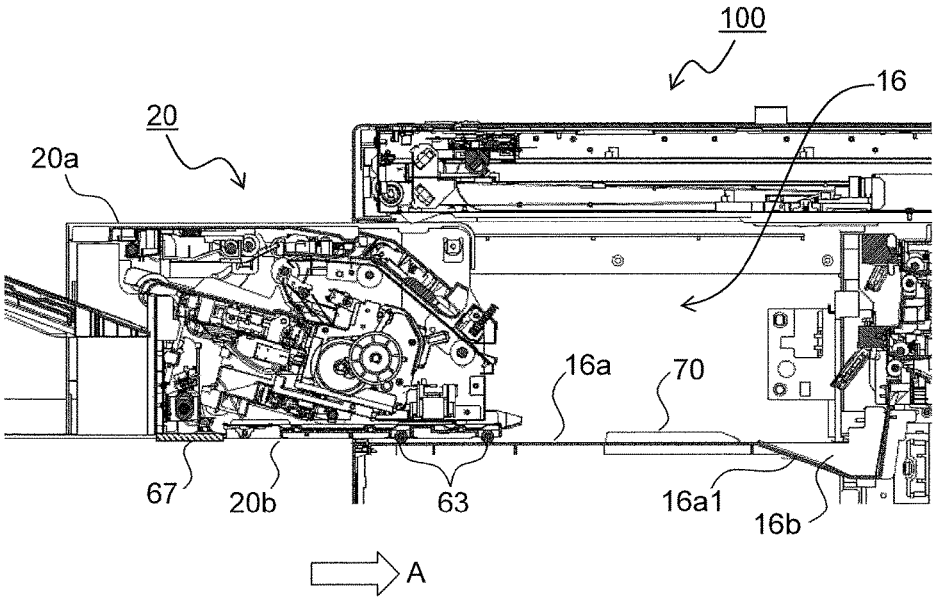
FIG. 6 is a side sectional view showing a state where insertion of the sheet post-processing device into an in-body discharge space has started.

Next, a procedure for attaching the sheet post-processing device 20 in the image forming apparatus 100 will be described. First, as shown in FIG. 6, a downstream-side end part of the sheet post-processing device 20 in the insertion direction is placed on the bottom face 16*a* of the in-body discharge space 16. In this state, the first wheels 63, which protrude from the frame 20*b*, are in contact with the bottom face 16*a*.

Figure 7:
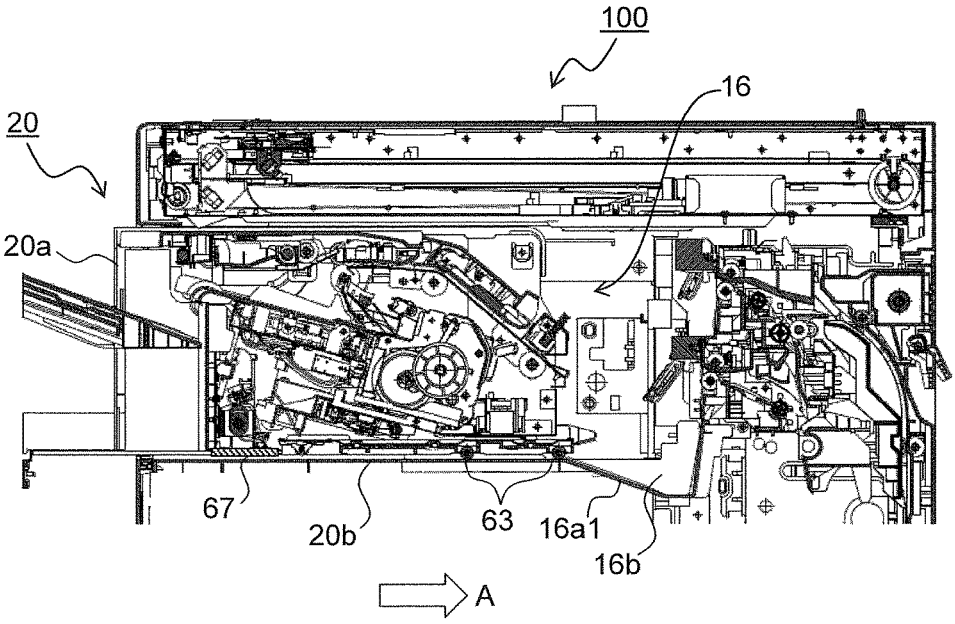
FIG. 7 is a side sectional view showing a state where the sheet post-processing device is in the middle of being inserted into the in-body discharge space.

From the state in FIG. 6, while the upstream side (left side in FIG. 6) of the sheet post-processing device 20 in the insertion direction is raised, with the frame 20*b* kept away from the bottom face 16*a* as shown in FIG. 7, the sheet post-processing device 20 is pushed in the insertion direction (rightward direction in FIG. 7). The first wheels 63 roll on the bottom face 16*a*, and thus the sheet post-processing device 20 is inserted into the in-body discharge space 16 smoothly.

Figure 8:
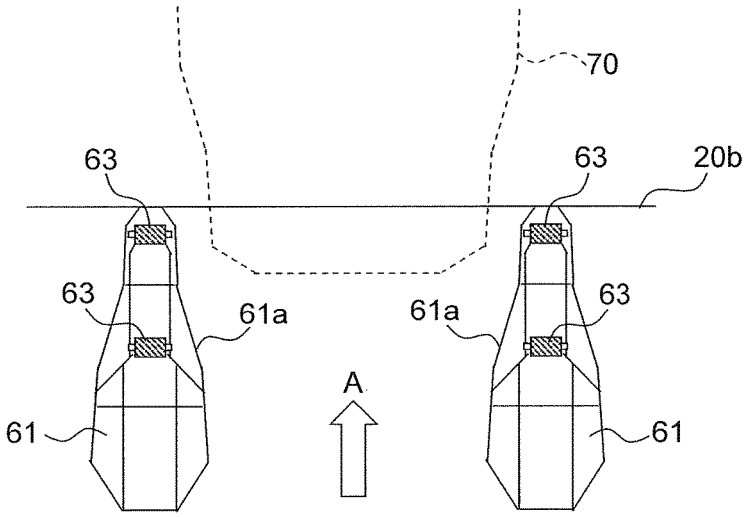
FIG. 8 is a plan view showing how guide members fixed to the frame engage with a convex portion.

As shown in FIG. 8, the interval between mutually opposite inner faces 61*a* of the pair of guide members 61, which is fixed to the frame 20*b*, is increasingly small from downstream to upstream (from top to bottom in FIG. 8) in the insertion direction (direction indicated by arrow A). The inner faces 61*a* of the guide members 61 have substantially the same shape as the side faces of the convex portion 70 formed on the bottom face 16*a*. As the sheet post-processing device 20 is inserted, the convex portion 70 is inserted between the pair of guide members 61 along the inner faces 61*a* of the pair of guide members 61. As a result, the sheet post-processing device 20 is positioned in the width direction relative to the in-body discharge space 16.

Figure 9:
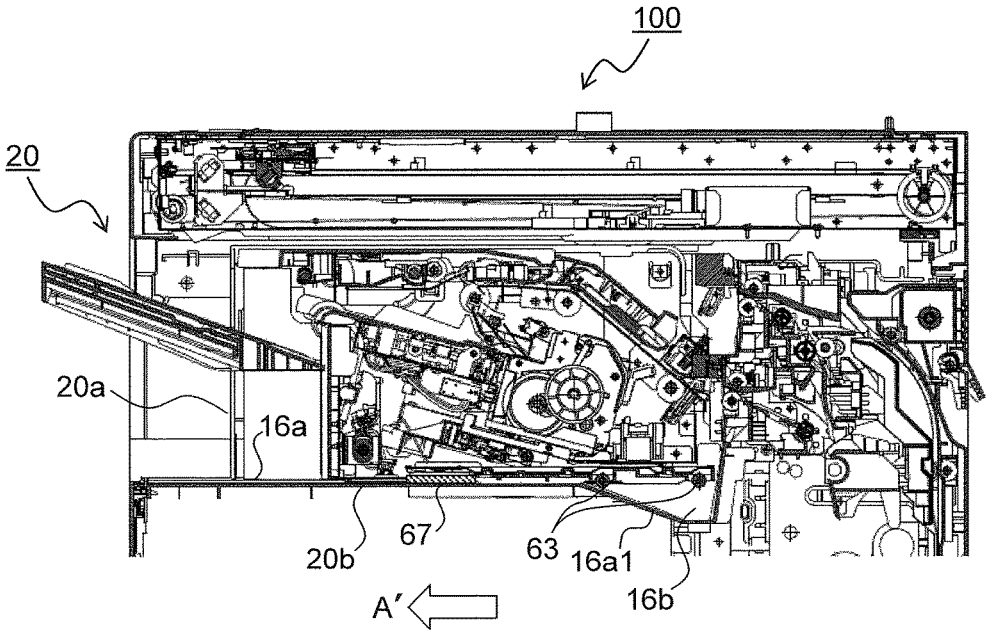
FIG. 9 is a side sectional view showing a state where the sheet post-processing device has been inserted up to an attached position in the in-body discharge space.

When the sheet post-processing device 20 is inserted up to a predetermined position, as shown in FIG. 9, the first wheels 63 fit into a concave portion 16*b* formed by an inclined face 16*a*1 of the bottom face 16*a*, and the attachment of the sheet post-processing device 20 is completed. As the first wheels 63 fit into the concave portion 16*b*, the frame 20*b* approaches the bottom face 16*a*, and then instead of the first wheels 63, the second wheels 65 make contact with the bottom face 16*a*, preventing the frame 20*b* from rubbing against the bottom face 16*a* and scratching the bottom face 16*a* immediately before the completion of the insertion of the sheet post-processing device 20.

In a state after the completion of the insertion of the sheet post-processing device 20, the second wheels 65 and the anti-slip plate 67 are in contact with the bottom face 16*a*. To enable the sheet post-processing device 20 to move in the extraction direction (direction indicated by A' in FIG. 9), the first wheels 63, which have fitted into the concave portion 16*b*, need to move over the inclined face 16*a*1 of the bottom face 16*a*, and in addition the coefficient of friction between the anti-slip plate 67 and the bottom face 16*a* is high, preventing the sheet post-processing device 20 from moving easily.

To remove the sheet post-processing device 20, from the state in FIG. 9, while the upstream side of the sheet post-processing device 20 in the insertion direction is held, with the frame 20*b* kept away from the bottom face 16*a*, the sheet post-processing device 20 is moved in the extraction direction (direction indicated by A' in FIG. 9). The second wheels 65 remain in contact with the bottom face 16*a* until the first wheels 63 move over the inclined face 16*a*1 of the bottom face 16*a*, and this prevents the frame 20*b* from making contact with the bottom face 16*a* and scratching the bottom face 16*a* immediately after the start of the extraction of the sheet post-processing device 20.

With the construction according to the present disclosure, when the sheet post-processing device 20 is inserted into the in-body discharge space 16, or when the sheet post-processing device 20 is extracted out of the in-body discharge space 16, the frame 20*b* does not rub against the bottom face 16*a*. Thus, the sheet post processing device 20 can be inserted and extracted smoothly, and the bottom face 16*a* can be prevented from being scratched. Moreover, near both end parts of the frame 20*b* in the width direction, where the weight of the body 20*a* concentrates, the first and second wheels 63 and 65 are arranged, and thus the frame 20*b* and the bottom face 16*a* can be effectively prevented from rubbing against each other.

Moreover, the first wheels 63 fit into the concave portion 16*b* in the bottom face 16*a*, and thereby prevent the sheet post-processing device 20 from moving easily, preventing the sheet post-processing device 20 from dropping out of the in-body discharge space 16. Moreover, the first and second wheels 63 and 65 are arranged to the downstream side in the insertion direction from the center of the frame 20*b*, and thus when in the middle of the insertion or extraction of the sheet post-processing device 20 the work is interrupted and it ceases to be held in a hand, the upstream side of the sheet post-processing device 20 in the insertion direction tips down and makes contact with the bottom face 16*a*, preventing the sheet post-processing device 20 from dropping out. Furthermore, to the upstream-side end part of the frame 20*b*, the anti-slip plate 67 is attached, and this helps more effectively prevent the sheet post-processing device 20 from dropping out of the in-body discharge space 16.

Moreover, the first wheels 63 fit into the concave portion 16*b* in the bottom face 16*a* and thereby permit the sheet post-processing device 20 to be positioned in the insertion direction. Furthermore, the inner faces 61*a* of the pair of guide members 61 provided on the frame 20*b* are given substantially the same shape as the side faces of the convex portion 70 formed on the bottom face 16*a*, and this permits the sheet post-processing device 20 to be positioned in the width direction by exploiting the engagement between the pair of guide members 61 and the convex portion 70.

The present disclosure is not limited to the embodiment described above but allows for many modifications within a scope not departing from the spirit of the present disclosure. For example, although the embodiment described above deals with a sheet post-processing device 20 provided with a punch hole forming device inside a body 20*a*, the punch hole forming device may be configured such that it can be attached to the image forming apparatus 100 separately from the sheet post-processing device 20.

Although the above embodiment deals with, as an example, a sheet post-processing device 20 that is attached in an in-body discharge space 16 in an image forming apparatus 100, for example, in a case where an intermediary unit is inserted into the in-body discharge space 16 and by use of the intermediary unit a sheet post-processing device attached to an outer side face of the image forming apparatus 100 and the discharge part of the image forming apparatus 100 are coupled together, the present disclosure can be applied to the intermediary unit.

The present disclosure is applicable to a sheet conveying device that is inserted into an in-body discharge space in an image forming apparatus. By employing the present disclosure, it is possible to provide a sheet conveying device that, when inserted into an in-body discharge space in an image forming apparatus, can prevent itself from dropping out of the main body of the image forming apparatus and can prevent the image forming apparatus from being scratched, and to provide an image forming apparatus provided with such a sheet conveying device.

What is claimed is:

1. A sheet conveying device comprising:

a body including a sheet conveying mechanism; and a frame supporting the body, the sheet conveying device being attached so as to be insertable and extractable along a sheet stacking face formed in an in-body discharge space of an image forming apparatus, the sheet stacking face having an inclined face with an upward gradient toward a downstream side in a sheet discharge direction, wherein the sheet conveying device includes a plurality of first wheels and second wheels arranged to a downstream side from a center of an opposite face of the frame located opposite the sheet stacking face, the first and second wheels being rotatable in an insertion or extraction direction, the first wheels are arranged on a downstream side of the second wheels in the insertion direction of the sheet conveying device and protrude from the opposite face by a larger amount than the second wheels, and the first wheels fit into a concave portion formed in the sheet stacking face by the inclined face to enable the second wheels to make contact with the sheet stacking face.

2. The sheet conveying device of claim 1, wherein at both end parts of the frame in a width direction thereof perpendicular to the insertion direction of the sheet conveying device, a pair of guide rails supporting the body so as to be slidable in the insertion direction is provided, and the first and second wheels are arranged near both end parts of the opposite face in a width direction thereof.

3. The sheet conveying device of claim 2, wherein in a central part of the opposite face in the width direction thereof, a step portion in a shape concave upward is formed, and on both sides of the step portion in a width direction thereof, a proximate portion closest to a bottom face of the in-body discharge space is formed, and the first and second wheels are arranged in the step portion, near both end parts of the step portion in the width direction thereof, the first wheels protruding from the proximate portion by a larger amount than the second wheels.

4. The sheet conveying device of claim 1, wherein to an upstream side from the center of the opposite face in the insertion direction of the sheet conveying device, an anti-side member with a higher coefficient of friction to the sheet stacking face than the frame is arranged.

5. The sheet conveying device of claim 1, wherein when the frame is moved along the insertion direction or the extraction direction of the sheet conveying device, at least either the first wheels or the second wheels are in contact with the sheet stacking face.

6. The sheet conveying device of claim 1, wherein to the opposite face, a pair of guide members arranged at a predetermined interval from each other in the width direction of the frame perpendicular to the insertion direction of the sheet conveying device are fixed, the pair of guide members engaging with a convex portion formed on the sheet stacking face.

7. The sheet conveying device of claim 1, wherein the sheet conveying device is a sheet post-processing device accepting a sheet having an image formed thereon by the image forming apparatus in order to perform at least one of a binding process, a punch hole forming process, and a sorting process.

8. An image forming apparatus comprising the sheet conveying device of claim 1.

* * * * *